US012359658B1

(12) United States Patent
Nettesheim

(10) Patent No.: US 12,359,658 B1
(45) **Date of Patent: *Jul. 15, 2025**

(54) DIAPHRAGM PUMPING

(71) Applicant: PSG Germany GmbH, Duisburg (DE)

(72) Inventor: Simon Dario Nettesheim, Krefeld (DE)

(73) Assignee: PSG Germany GmbH, Duisburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/608,376

(22) Filed: Mar. 18, 2024

Related U.S. Application Data

(63) Continuation of application No. 17/464,989, filed on Sep. 2, 2021, now Pat. No. 11,933,286.

(51) Int. Cl.
*F04B 43/02* (2006.01)

(52) U.S. Cl.
CPC ..... *F04B 43/025* (2013.01)

(58) Field of Classification Search
CPC ..... F04B 43/026; F04B 43/025; F04B 43/04; F04B 43/0054; F04B 45/04; F04B 45/043; F04B 45/047
USPC ..... 417/473, 474, 475
See application file for complete search history.

(56) References Cited

U.S. PATENT DOCUMENTS 4,153,391 A * 5/1979 Hartley ..... F04B 43/026 417/269
5,476,367 A * 12/1995 Zimmermann ..... F04B 49/24 417/415
5,626,464 A * 5/1997 Schoenmeyr ..... F04B 43/026 92/100
5,632,607 A * 5/1997 Popescu ..... F04B 53/106 417/415
5,791,882 A * 8/1998 Stucker ..... F04B 43/0045 417/269

(Continued)

*Primary Examiner* — Mark A Laurenzi
*Assistant Examiner* — Benjamin Doyle
(74) *Attorney, Agent, or Firm* — Fish & Richardson P.C.

(57) ABSTRACT

An assembly for a diaphragm pump includes: a body defining a plurality of diaphragm chambers spaced apart about a body axis, wherein each diaphragm chamber defines a membrane opening, an inlet chamber in fluid communication with each diaphragm chamber, and an outlet chamber in fluid communication with each diaphragm chamber; and a plurality of flexible membranes that each comprise an outer edge, wherein the body is configured to clamp the outer edge of each membrane along a corresponding membrane opening to seal a corresponding one of the diaphragm chambers; wherein the membranes are configured to deflect substantially in parallel to the body axis to suction fluid into each diaphragm chamber from the inlet chamber and discharge fluid from each diaphragm chamber into the outlet chamber; wherein each membrane comprises a coupling section configured to couple the membrane to a pump drive and arranged along a diaphragm axis that extends in parallel to the body axis, and a deflection section arranged radially outwardly from the coupling section and configured to deflect in response to movement of the pump drive; and wherein movement of the coupling section radial to and about the diaphragm axis is restricted to suppress movement of the deflection section radial to and about the diaphragm axis.

14 Claims, 7 Drawing Sheets

(56) References Cited

U.S. PATENT DOCUMENTS 6,206,664 B1 * 3/2001 Kakizawa ..... F04B 43/026 92/169.1
6,941,853 B2 * 9/2005 Hembree ..... F04B 43/009 92/5 R
7,424,847 B2 * 9/2008 Hart ..... F04B 43/0009 92/98 R
7,819,636 B2 * 10/2010 Huang ..... F04B 45/022 417/523
9,239,119 B2 * 1/2016 Morris ..... F16K 7/17
10,641,262 B2 * 5/2020 Inoue ..... F04B 43/0045
10,648,464 B2 * 5/2020 Fitzpatrick ..... F04B 27/1063
10,920,764 B2 * 2/2021 Nishimura ..... F04B 49/22
11,596,273 B2 * 3/2023 Harris ..... F04B 43/025
2002/0051717 A1 * 5/2002 Fukami ..... F04B 43/04 417/413.1
2006/0204367 A1 * 9/2006 Meza ..... F04B 43/0081 417/53
2008/0010041 A1 * 1/2008 McDaniel ..... G06F 30/00 703/1
2009/0079734 A1 * 3/2009 McDaniel ..... G06T 19/00 345/419
2010/0025614 A1 * 2/2010 Cai ..... F04B 43/025 251/324
2015/0337816 A1 * 11/2015 Cai ..... F04B 17/03 417/375
2015/0337832 A1 * 11/2015 Cai ..... F04B 43/021 417/472
2017/0306935 A1 * 10/2017 Fujiwara ..... F04B 43/026
2018/0061676 A1 * 3/2018 Kashiyama ..... H01L 21/67023
2018/0142684 A1 * 5/2018 Abel ..... F04B 53/1067
2018/0147062 A1 * 5/2018 Ay ..... A61F 2/30942
2018/0239334 A1 * 8/2018 Tramel, Jr. ..... G01B 21/04
2019/0040856 A1 * 2/2019 Schwarzer ..... F04B 17/04
2021/0355928 A1 * 11/2021 Schoenmeyr ..... F04B 43/04
2021/0355934 A1 * 11/2021 Nettesheim ..... F04B 53/1065
2021/0355936 A1 * 11/2021 Nettesheim ..... F04B 43/04
2022/0106955 A1 * 4/2022 Auernhammer ..... F04B 45/04
2022/0170560 A1 * 6/2022 Kodandaramaiah .... F04B 43/02
2022/0275798 A1 * 9/2022 Gebauer ..... F04B 43/026

* cited by examiner

DIAPHRAGM PUMPING

CROSS-REFERENCE TO RELATED APPLICATIONS

This application is a continuation of U.S. patent application Ser. No. 17/464,989, entitled "Diaphragm Pumping," filed Sep. 2, 2021, which is incorporated herein by reference in its entirety.

TECHNICAL FIELD

This invention relates to diaphragm pumps and methods of their use, and more particularly to pump chambers for diaphragm pumps.

BACKGROUND

Diaphragm pumps or membrane pumps are a type of positive displacement pump that uses a reciprocating motion of a flexible diaphragm to pump a fluid. Specifically, the reciprocating motion of the diaphragm can change the internal pressure of a pump chamber. The change in pressure opens an inlet valve to suction fluid into the pump chamber or opens an outlet valve to discharge fluid from the pump chamber. Diaphragm pumps are sometimes used in life sciences and pharmaceutical applications to pump fluids under sterile conditions. The longevity and efficiency of diaphragm pumps is generally determined among other influences by the movement of the flexible diaphragm and the seal between a pump housing and the diaphragm.

SUMMARY

According to one aspect of the invention, an assembly for a diaphragm pump (e.g. a pump chamber) includes: a body defining a plurality of diaphragm chambers spaced apart about a body axis, wherein each diaphragm chamber defines a membrane opening, an inlet chamber in fluid communication with each diaphragm chamber, and an outlet chamber in fluid communication with each diaphragm chamber; and a plurality of flexible membranes that each comprise an outer edge, wherein the body is configured to clamp the outer edge of each membrane along a corresponding membrane opening to seal a corresponding one of the diaphragm chambers; wherein the membranes are configured to deflect substantially in parallel to the body axis to suction fluid into each diaphragm chamber from the inlet chamber and discharge fluid from each diaphragm chamber into the outlet chamber; wherein each membrane comprises a coupling section configured to couple the membrane to a pump drive and arranged along a diaphragm axis that extends in parallel to the body axis, and a deflection section arranged radially outwardly from the coupling section and configured to deflect in response to movement of the pump drive; and wherein movement of the coupling section radial to and about the diaphragm axis is restricted to suppress movement of the deflection section radial to and about the diaphragm axis.

This movement may be advantageously suppressed by selection of particular geometrical dimensions of the drive and the membrane to achieve an advantageous balance.

In some embodiments, the assembly includes a mounting ring arranged to wobble about the body axis in response to movement of the pump drive, wherein the coupling section of each membrane is coupled to the mounting ring.

The coupling section of each membrane can be supported by a rigid piston that suppresses deflection of the coupling section.

In some instances, the movement of the coupling section along the diaphragm axis defines a stroke length, and the deflection section has in cross-section an arcuate length greater than the stroke length In some embodiments, the outer edge of each membrane comprises a sealing bead having a substantially circular or semi-circular cross-section. For example, the outer edge of the membrane can define a sealing lip arranged radially outward from the sealing bead. The sealing lip can have a smaller thickness than the sealing bead.

The body can be formed of stainless steel or plastic in some instances.

According to another aspect of the invention, an assembly for a diaphragm pump (e.g. a diaphragm pump) includes a body defining a plurality of diaphragm chambers spaced apart about a body axis, wherein each diaphragm chamber defines a membrane opening, an inlet chamber in fluid communication with each diaphragm chamber, and an outlet chamber in fluid communication with each diaphragm chamber; a plurality of flexible membranes that each comprise an outer edge, wherein the body is configured to clamp the outer edge of each membrane along a corresponding membrane opening to seal a corresponding one of the diaphragm chambers; and a mounting ring configured to wobble about the body axis and defining a mounting ring axis; wherein the membranes are configured to deflect substantially in parallel to the body axis to suction fluid into each diaphragm chamber from the inlet chamber and discharge fluid from each diaphragm chamber into the outlet chamber; wherein each membrane comprises a coupling section coupled to the mounting ring and arranged along a diaphragm axis that extends in parallel to the body axis, and a deflection section arranged radially outwardly from the coupling section and configured to deflect in response to movement of the pump drive; and wherein an outer edge of each of the membranes and the mounting ring axis intersect the body axis at substantially the same location.

In some embodiments, the movement of the coupling section along the diaphragm axis defines a stroke length, and a length of the deflection section is greater than the stroke length.

The outer edge of each membrane can include a sealing bead having a substantially circular or semi-circular cross-section. For example, the outer edge of the membrane can define a sealing lip arranged radially outward from the sealing bead. The sealing lip can have a smaller thickness than the sealing bead.

The body can be formed of stainless steel or plastic in some instances.

According to another aspect of the invention, a method of designing a diaphragm pump includes designing a body defining a plurality of diaphragm chambers spaced apart about a body axis, wherein each diaphragm chamber defines a membrane opening, an inlet chamber in fluid communication with each diaphragm chamber, and an outlet chamber in fluid communication with each diaphragm chamber; designing a plurality of flexible membranes that each comprise an outer edge, wherein the body is configured to clamp the outer edge of each membrane along a corresponding membrane opening to seal a corresponding one of the diaphragm chambers, and wherein the membranes are configured to deflect substantially in parallel to the body axis to suction fluid into each diaphragm chamber from the inlet chamber and discharge fluid from each diaphragm chamber into the outlet chamber; and designing a mounting ring coupled to a coupling section of each membrane; orienting the mounting ring to form a mounting angle relative to the body axis, the mounting angle originating from a first mounting origin along the body axis; simulating the deflection of at least one membrane relative to the body axis; translating the mounting ring along the body axis, such that the mounting angle originates from a second mounting origin along the body axis that is different from the first mounting origin; simulating the deflection of at least one membrane relative to the body axis; and selecting the first mounting origin or the second mounting origin based on the simulated deflection of the at least one membrane relative to the body axis.

In some embodiments, the first mounting origin is aligned with the outer edge of each membrane along the body axis.

Simulating the deflection of at least one membrane relative to the body axis can be based on a 3D CAD simulation.

In some instances, translating the mounting ring along the body axis includes modifying a thickness of the body between the flexible membranes and the mounting ring.

In some cases, the coupling section of each membrane is coupled to the mounting ring via a piston. Translating the mounting ring along the body axis can include modifying a length of the pistons.

Various examples of the invention can provide a pump chamber for a diaphragm pump in which non-axial displacement of the diaphragm is reduced. Although axial movement is needed to pump fluid through the diaphragm pump, movement of the membrane radially to or about this axis or in circumferential direction about the machine axis may cause wear of the diaphragm. Reducing wear of the diaphragm can improve the longevity of the diaphragm pump and reduces particle spallation, while maintaining pump efficiency in some cases. Reducing non-axial movement can also reduce shear forces exerted by the pump on the fluid moving through the pump. Reduction in shear forces can be beneficial in certain biotechnology applications.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
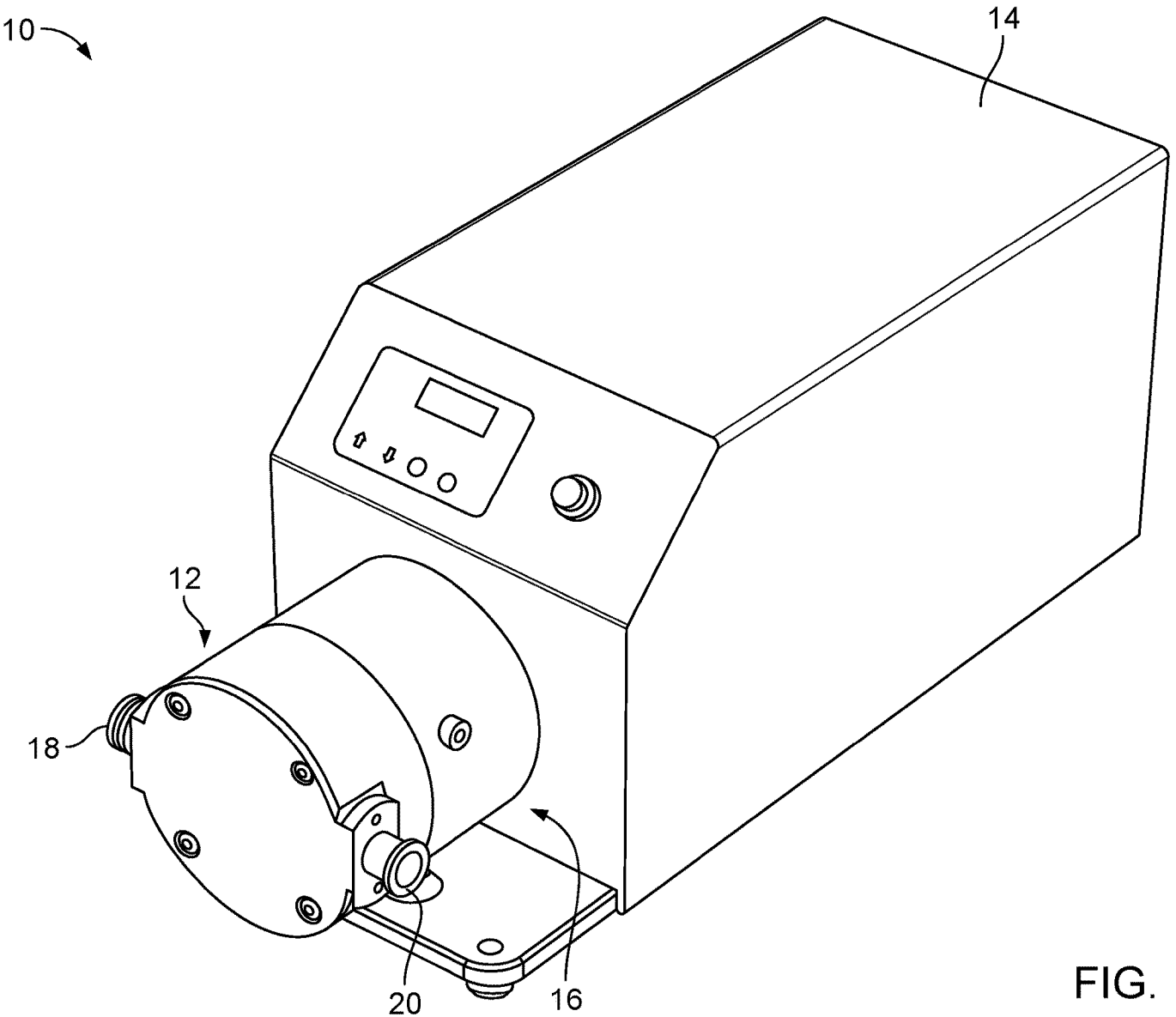
FIG. 1 is a perspective view of an example diaphragm pump.

FIG. 1 is a perspective view of an example diaphragm pump 10. In some instances, the pump 10 is a quaternary diaphragm pump for use in biological manufacturing processes. The pump 10 includes a pump chamber 12, a drive 14, and a drive interface 16 that mechanically connects the pump chamber 12 and the drive 14. The pump chamber 12 defines a fluid inlet 18 and a fluid outlet 20 for fluid to enter and exit the pump. Depending on the particular application, the drive 14 can include a three-phase induction motor, a synchronous servomotor, or a brushless DC electric motor to name a few examples. The drive interface 16 includes, e.g., a drive shaft that connects the drive 14 to the pump chamber 12 to pump fluid from the fluid inlet 18, through the pump chamber 12, and out the fluid outlet 20. Details of the pump chamber 12 and the drive interface 16 are described below in reference to FIG. 4.

Figure 2:
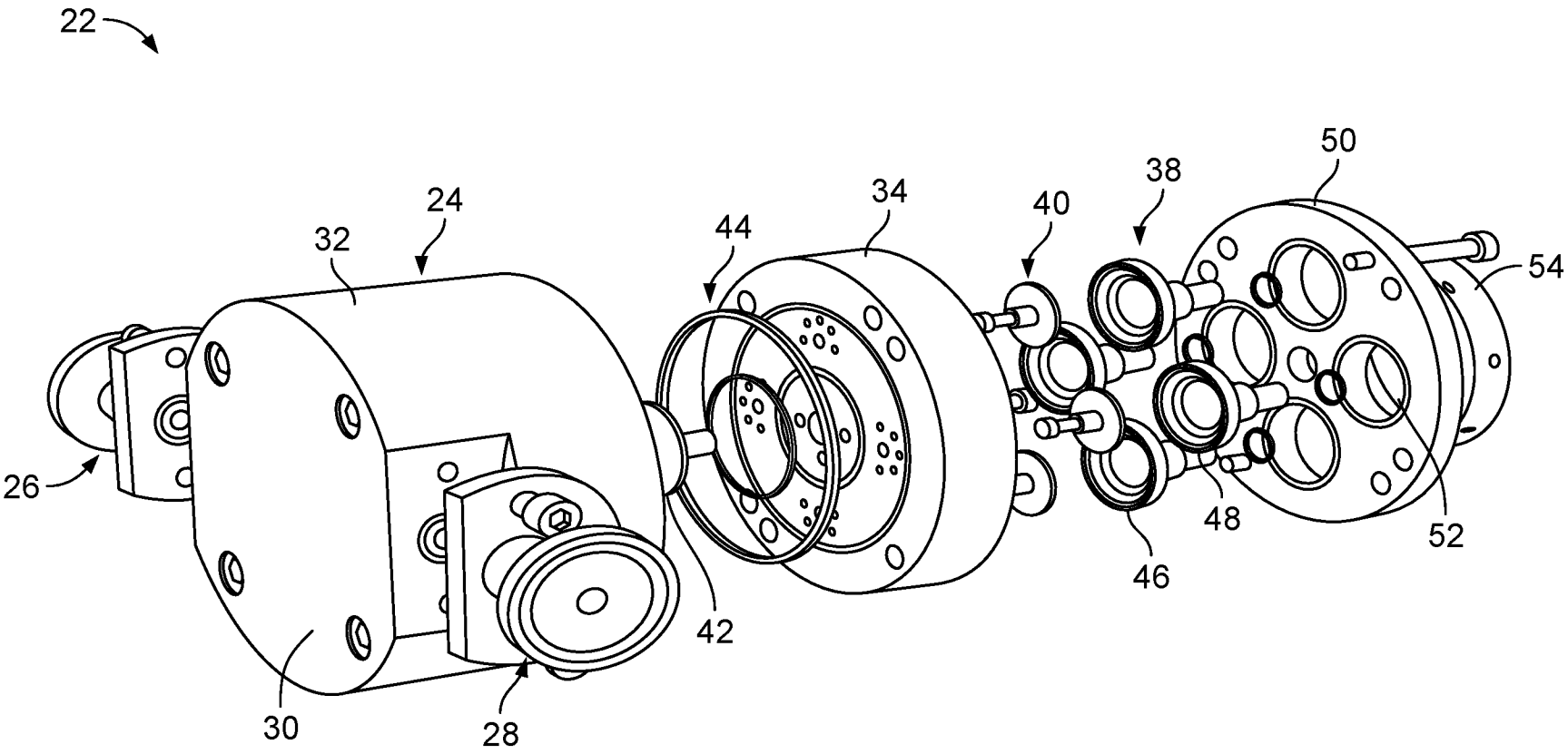
FIG. 2 is an exploded perspective view of a pump chamber.

FIG. 2 is an exploded perspective view of a pump chamber 22. For example, the pump chamber 22 can form part of the pump 10 shown in FIG. 1. The pump chamber 22 includes a housing 24 that defines a fluid inlet 26 and a fluid outlet 28, as described in reference to FIG. 1. As also shown in in FIG. 3, the housing 24 defines an inlet chamber 25 in fluid communication with the fluid inlet 26 and an outlet chamber 27 in fluid communication with the outlet 28. The housing 24 has a generally cylindrical shape that includes an end surface 30 and a peripheral surface 32. In FIGS. 1 and 2, the fluid inlet 18, 26 and the fluid outlet 20, 28 are arranged along the peripheral surface 32. In some embodiments, the fluid inlet and/or the fluid outlet can also be arranged on the end surface 30 of the housing 24.

Figure 3:
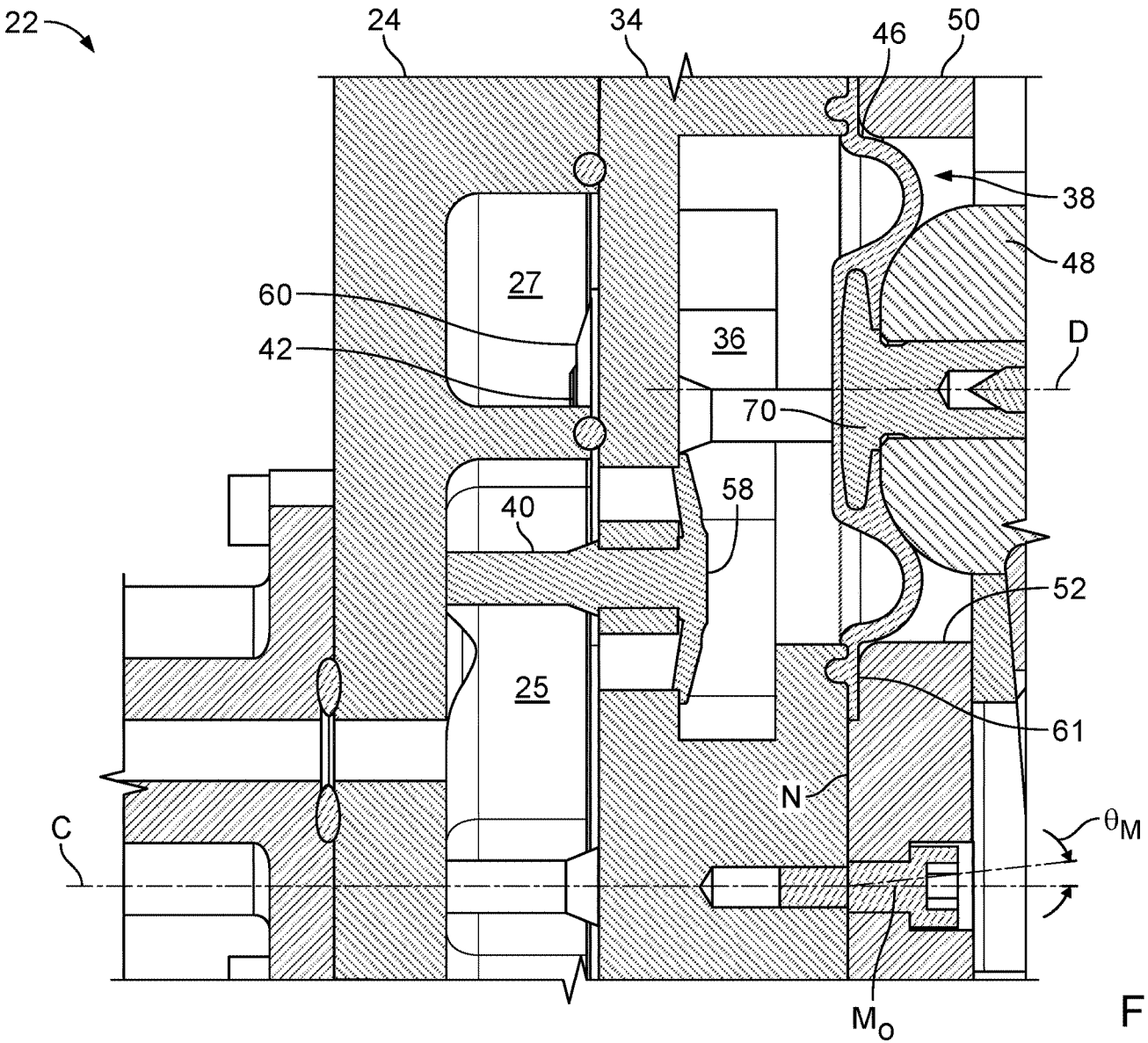
FIG. 3 is a schematic cross-sectional view through a single diaphragm chamber of a pump chamber.

The pump chamber 22 also includes a valve plate 34 that defines a plurality of diaphragm chambers 36 (FIG. 3) that are each sealed by a diaphragm 38. Each diaphragm chamber 36 is in fluid communication with the inlet chamber 25 via an inlet valve 40 and the outlet chamber 27 via an outlet valve 42. Although FIG. 2 depicts a single outlet valve 42, some embodiments of the pump chamber 22 can include one outlet valve 42 for each diaphragm chamber 36 (FIG. 3). In some instances, sealing rings 44 are provided between the housing 24 and the valve plate 34 to seal the concentrically positioned inlet and outlet chambers 25, 27. For example, the inlet chamber 25 can be formed in the shape of a ring that surrounds the outlet chamber 27. However, as shown in FIG. 3, the positions of the inlet and outlet chambers 25, 27 can also be reversed.

Figure 4:
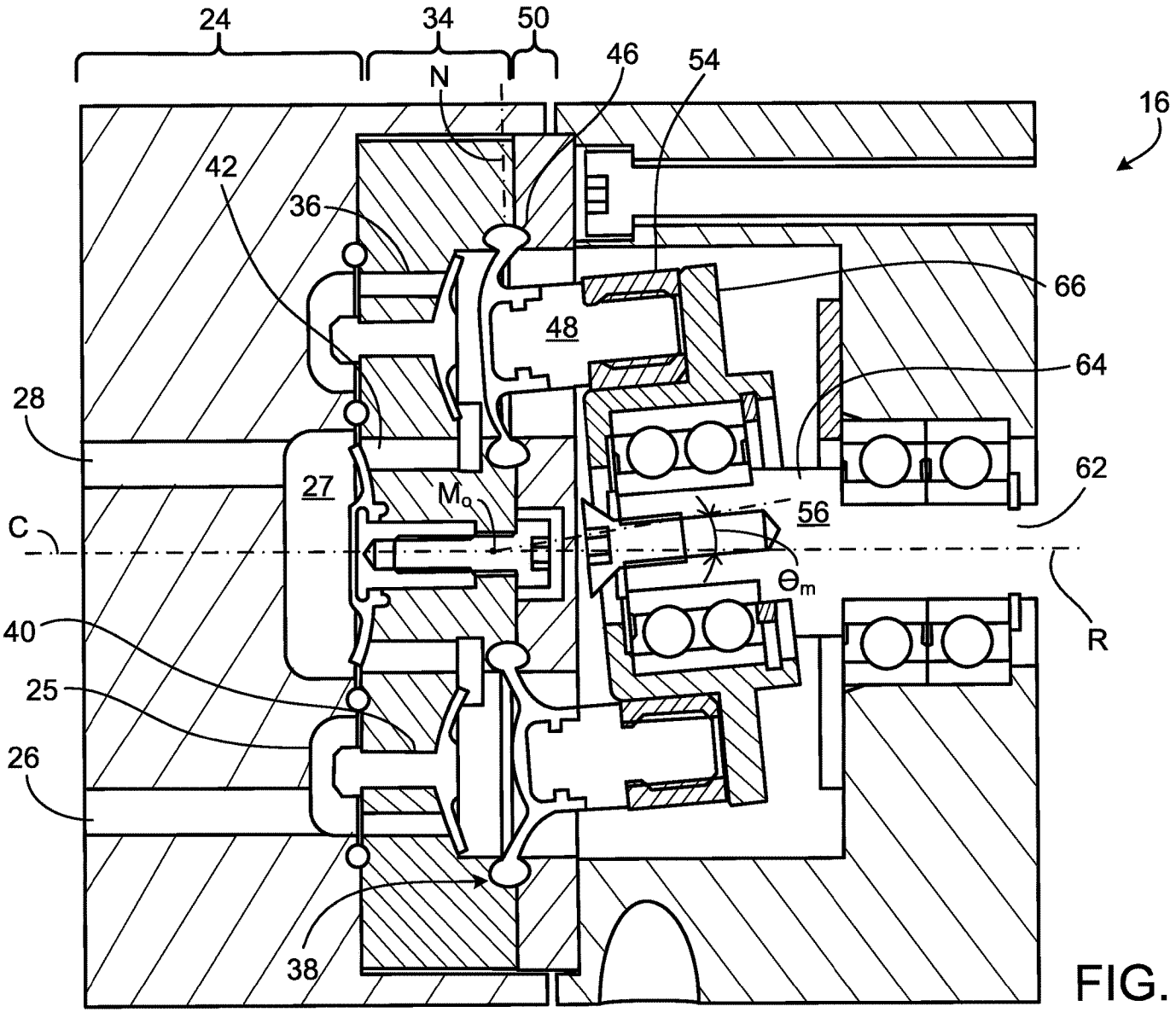
FIG. 4 is a partial cross-sectional view of an example pump chamber and drive interface.

Each diaphragm 38 includes a flexible membrane 46 and a piston 48. Suitable membrane materials include thermoplastic elastomers such as SANTOPRENE, and polymers like silicone or PTFE. The flexible membrane 46 has a generally circular shape with an outer edge that is clamped between the valve plate 34 and a carrier plate 50. The carrier plate 50 defines a plurality of openings 52 that correspond to the diaphragm chambers 36. For example, a quaternary diaphragm pump has exactly four diaphragm chambers 36 that mimic the pumping motion of a human heart. However, the principles described herein can also be applied to a pump that has fewer or more diaphragm chambers. The carrier plate 50 also includes a mounting ring 54 (sometimes referred to as a "clamp ring") that provides a mechanical interface between the diaphragms 38 and a drive shaft 56 (FIG. 4).

The pump housing 24, the valve plate 34, and the carrier plate 50 can form the body of a pump chamber 22. In some instances, the body of the pump chamber can include more or fewer plates. The body of the pump chamber can be formed of stainless steel or of plastic in some examples. Stainless steel can be sterilized for biological and pharmaceutical applications. Conversely, a plastic body (such as of PP, PP-DWST, PETP, PA, PA6.6-GFK, PEEK or PVDF) can form part of a pump chamber 22 that is replaced in its entirety, eliminating the downtime associated with sterilization operations.

FIG. 3 is a schematic cross-sectional view through a single diaphragm chamber 36 of a pump chamber 22. FIGS. 2 and 3 use the same reference numerals to indicate corresponding parts, although the exact arrangement of parts may not be the same.

In FIG. 3, the diaphragm chamber 36 includes a volume defined by the valve plate 34. The pump chamber 36 is in fluid communication with the inlet chamber 25 via the inlet valve 40 and in fluid communication with the outlet chamber 27 via the outlet valve 42. Part of the diaphragm chamber 36 is defined by the diaphragm 38. Specifically, the flexible membrane 46 is clamped between the valve plate 34 and the carrier plate 50 to form a portion of the diaphragm chamber 36.

The flexible membrane 46 can be displaced along a diaphragm axis D via the piston 48. Displacement of the flexible membrane 46 changes the volume of the diaphragm chamber 36 and thus the pressure within the diaphragm chamber 36. For example, FIG. 3 depicts the membrane 46 in a neutral position N along the diaphragm axis D. In the neutral position N, the membrane 46 is at rest, and no external forces are applied to the membrane 46 via the piston 48. The neutral position N is located at the physical interface between the valve plate 34 and the carrier plate 50. In some instances, the membrane 46 comprises a sealing flange 61 along its outer peripheral edge. The sealing flange 61 is clamped between the valve plate 34 and the carrier plate 50 to seal the diaphragm chamber 36 in a fluid-tight manner. Different configurations of the sealing flange 61 are described in reference to FIGS. 6A and 6B.

As the piston 48 is displaced to the right of the neutral position N, the volume of the diaphragm chamber 36 increases, and the pressure decreases. This creates suction that draws a valve body 58 of the inlet valve 40 to the right, drawing fluid from the inlet chamber 25 into the diaphragm chamber 36. Conversely, when the piston 48 is displaced to the left of the neutral position N, the volume of the diaphragm chamber 36 decreases, and the pressure increases. This creates pressure that pushes a valve body 60 of the outlet valve 42 to the left, discharging fluid from the diaphragm chamber 36 into the outlet chamber 27. In this way, the pump chamber 22 is configured to pump fluid from the inlet chamber 25 to the outlet chamber 27 via each diaphragm chamber 36.

FIG. 4 is a partial cross-sectional view of an example pump chamber 22 and drive interface 16. FIG. 4 uses the same reference numerals as FIGS. 2 and 3 to indicate corresponding parts, although the exact arrangement of parts may not be the same.

In FIG. 4, each of the pistons 48 is mounted to a common mounting ring 54 that provides a mechanical interface between the diaphragms 38 and the drive shaft 56 of the drive interface 16. The mounting ring 54 and the drive interface 16 allow rotational movement of the drive shaft 56 from a common drive 14 (not shown) to displace the diaphragms 38 along a chamber axis C of the pump chamber 22 to move fluid through the pump chamber, by a wobble induced by nutation of the axis of the mounting plate about the chamber axis C.

The drive shaft 56 is configured to rotate about a rotational axis R that is coaxial to the chamber axis C. The mounting ring 54 is arranged at a mounting angle $\theta_M$ relative to the chamber axis C and is mounted on a bearing that allows the mounting ring to wobble without rotation as the drive shaft rotates. The mounting angle $\theta_M$ originates at a mounting origin $M_O$ that coincides with the neutral position N, i.e., the interface between the valve plate 34 and the carrier plate 50. Due to the mounting angle $\theta_M$, the upper diaphragm 38 in FIG. 4 is displaced towards the housing 24 while the opposite, lower diaphragm 38 is displaced away from the housing 24. In other words, the upper diaphragm 38 is positioned to discharge fluid from the diaphragm chamber 36 into the outlet chamber 27, while the lower diaphragm 38 is positioned to suction fluid from the inlet chamber 25 into the diaphragm chamber 36. The distance along the chamber axis C between the membranes 46 of the upper and lower diaphragms 38 is sometimes referred to as the "stroke length" of the pump. A larger mounting angle $\theta_M$ increases the stroke length, while a smaller mounting angle $\theta_M$ decreases the stroke length. Typical values for the mounting angle $\theta_M$ range from 3 to 7 degrees in some instances (e.g., 5 degrees).

The drive shaft 56 includes a coaxial portion 62 that extends along the rotational axis R and an eccentric portion 64 that deviates from the rotational axis R by the mounting angle $\theta_M$. The mounting ring 54 connects to the eccentric portion 64 of the drive shaft 56 via a connection plate 66. For example, the mounting ring 54 can be configured to have an adjustable throughbore that clamps an outer peripheral surface of the connection plate 66. As the drive shaft 56 rotates about the rotational axis R, the diaphragms 38 are displaced along the chamber axis C in a sequence that can mimic the pumping of the human heart.

Figure 5A:
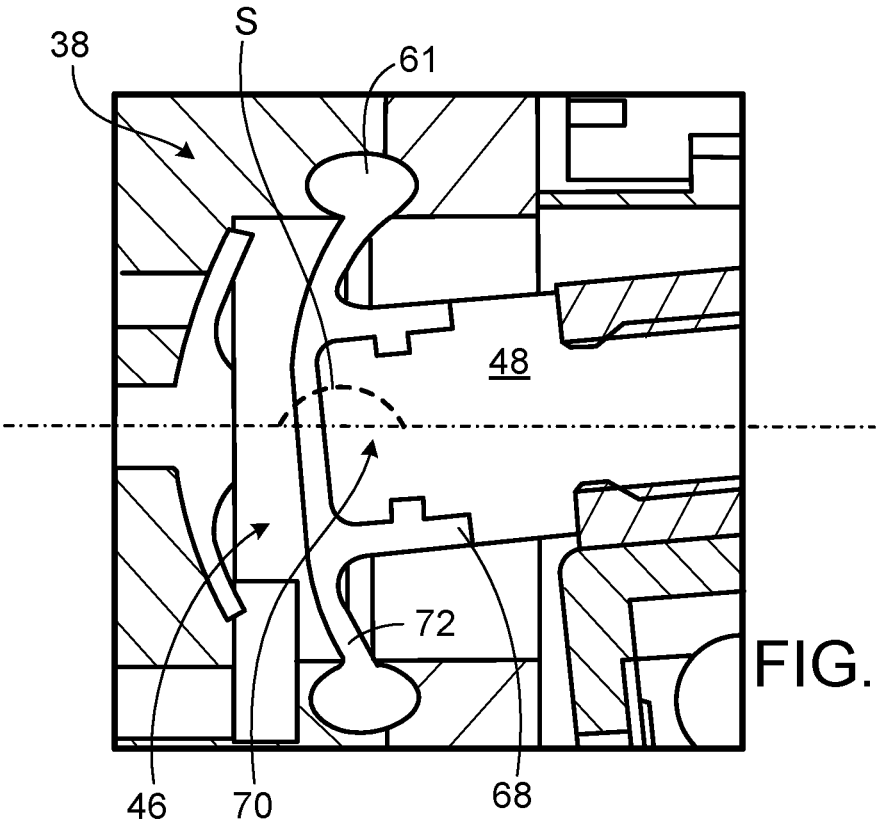
FIGS. 5A and 5B schematically represent the stroke of an individual diaphragm in FIG. 4 in two dimensions.
Figure 5B:
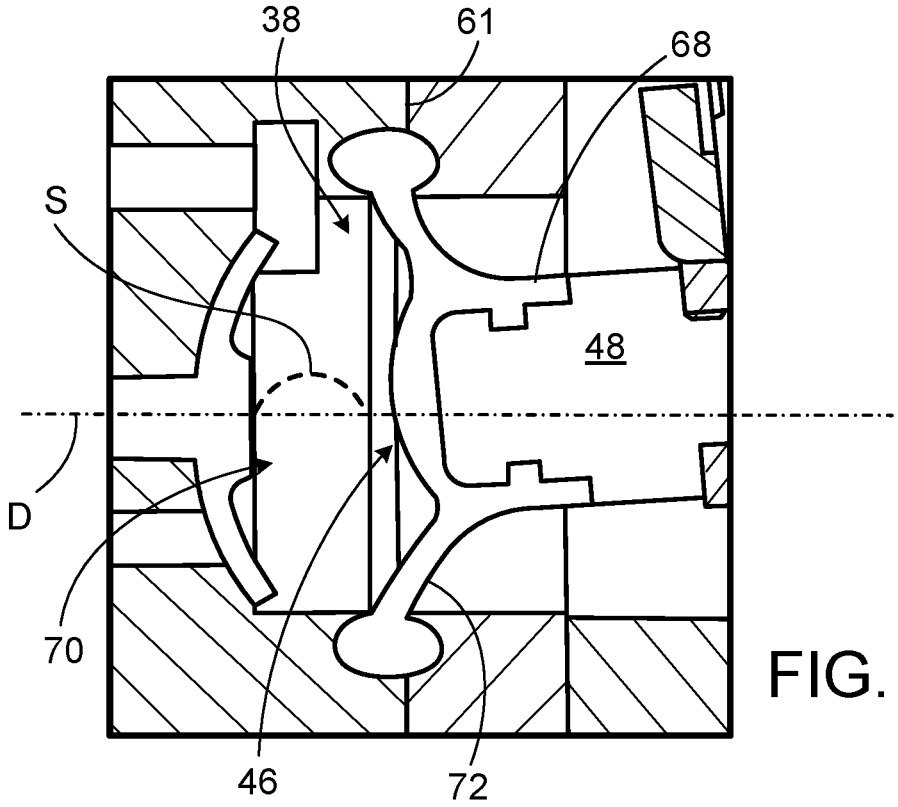

FIGS. 5A and 5B schematically represent the stroke S of an individual diaphragm 38 in FIG. 4 in two dimensions. Since the drive 14 drives the pistons 48 using rotational movement, the path of the piston 48 deviates slightly from the diaphragm axis D, which extends in parallel to the chamber axis C (FIGS. 3 and 4). A greater the deviation relative to the diaphragm axis D reduces the efficiency of the diaphragm stroke S. By arranging the mounting origin $M_O$ at the intersection of the chamber axis C and the interface between the valve plate 34 and the carrier plate 50, the deviation of stroke S from the diaphragm axis D can be minimized in some instances.

As previously described, each membrane 46 includes a sealing flange 61 that is clamped between the valve plate 34 and the carrier plate 50 to seal the diaphragm chamber 36. Each membrane 46 also includes a coupling section 68 that couples the membrane 46 and the piston 48. For example, the piston 48 can include an insert that is received by the coupling section 68. The insert 70 can be integrally formed with the rest of the piston 48 or can be a separate part that is connected to the piston 48 by appropriate means (FIG. 3).

The membrane 46 also includes a ring-shaped movement or deflection section 72 that is arranged between the sealing flange 61 and the coupling section 68. The sealing flange 61 and the coupling section 68 are each connected to substantially rigid components, e.g., the valve plate 34 or the piston 48. Once connected, these parts of the membrane 48 are not subjected to substantial stretching or deformation during an actual stroke. Rather, the deformation during each stroke is substantially concentrated on the deflection section 72 of the membrane 46.

The three-dimensional deformation of the deflection section 72 of the membrane 46 during each stroke S is complex and not readily modeled. However, it is believed that minimizing the deviation of the coupling section 68 from the diaphragm axis D also helps to suppress non-axial movement along the deflection section 72. Non-axial movement of the membrane, i.e., movement about or relative to the diaphragm axis D can reduce the efficiency of each diaphragm stroke and can increase wear on the membrane 46. Further, a reduction in non-axial movement of the membrane can reduce shear forces on the fluids pumped by the diaphragm pump.

Figure 6B:
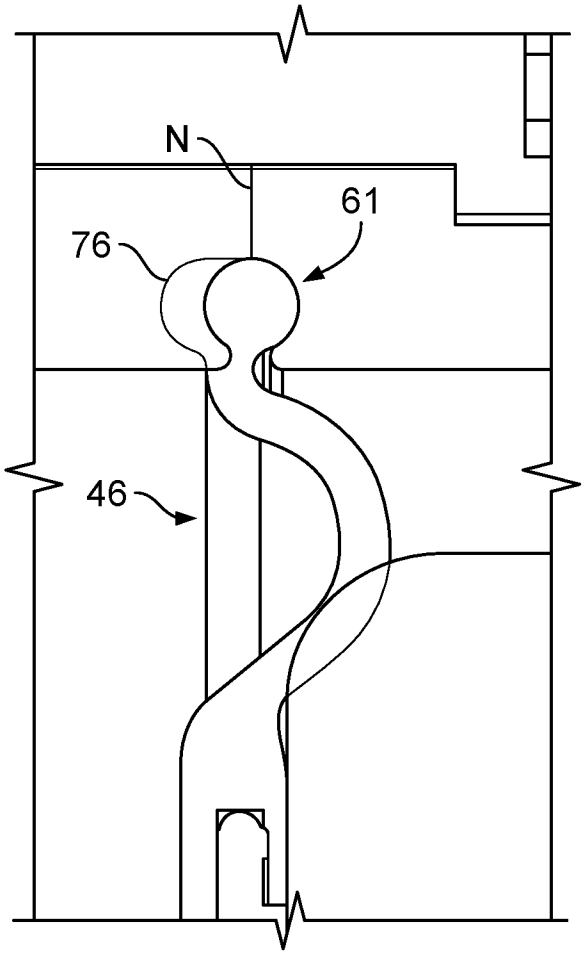
FIGS. 6A and 6B each depict a partial enlarged view of a membrane at rest.
Figure 6A:
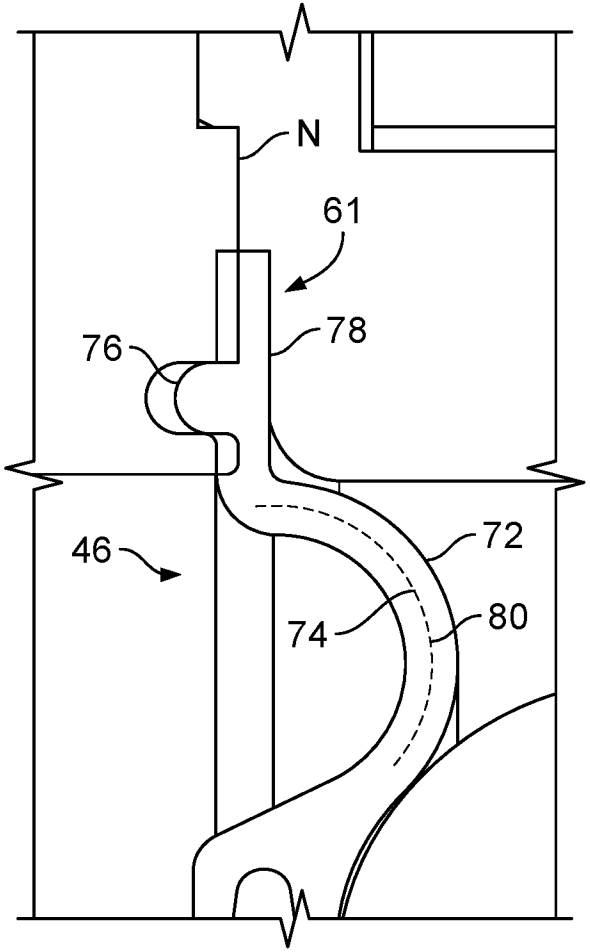

Referring to FIG. 6A, a partial enlarged view of the at-rest membrane 46 in FIG. 3 is shown. The deflection section 72 has an arcuate length 74 in cross-section at rest (substantially zero force applied to the membrane 46) that is greater than the length of the stroke S in some instances. If the length 74 is less than the length of stroke S, the deflection section 72 may be subjected to greater stretching and wear. However, if the length 74 is substantially longer than the length of the stroke S, the efficiency of the pump may decrease.

FIG. 6A also shows the sealing flange 61 in FIG. 3 in more detail. For instance, the sealing flange 61 can include a bead 76 that has a semi-circular cross-section. As shown in FIG. 6B, the bead 76 can also have a substantially circular cross-section in some cases. The sealing flange 61 can also include an optional lip 78 that extends radially outward from the bead 76. In some instances, the lip 78 can have a substantially rectangular cross-section. The combined bead 76 and lip 78 can form a mechanical seal that provides a tortuous path for the fluid in the diaphragm chamber 36, i.e., a labyrinth seal. An improvement in sealing performance may increase the longevity of the pump chamber 22 in some cases. Conversely, a sealing flange 61 that comprises a bead 76 at its radially outer edge may decrease the size of the membrane 46 and provide a more compact pump chamber 22.

As described above, in some instances, the mounting angle $\theta_M$ of the mounting ring 54 originates at a mounting origin $M_O$ that coincides with the neutral position N, i.e., the interface between the valve plate 34 and the carrier plate 50 (FIGS. 3 and 4). However, in some cases, the mounting origin $M_O$ can be moved to a different location along the chamber axis C according to a method of reducing transverse membrane movement in a pump chamber.

The method can include designing a body that defines a plurality of diaphragm chambers 36 spaced apart about a body axis, wherein each diaphragm chamber 38 defines a membrane opening 52, an inlet chamber 25 in fluid communication with each diaphragm chamber 36, and an outlet chamber 27 in fluid communication with each diaphragm chamber 36. As described above, the body may form part of a pump chamber 22 and include a housing 24, a valve plate 34, and a carrier plate 50.

The method can include designing a plurality of flexible membranes 46 that each comprise an outer edge, wherein the body is configured to clamp the outer edge of each membrane 46 along a corresponding membrane 52 opening to seal a corresponding one of the diaphragm chambers 36. The membranes 46 can be configured to deflect substantially in parallel to the body axis to suction fluid into each diaphragm chamber 36 from the inlet chamber 25 and discharge fluid from each diaphragm chamber 36 into the outlet chamber 27. The membranes 46 can form part of the diaphragms 38 described above and can include any of the aspects shown in FIGS. 3 to 6, for example.

The method can further include designing a mounting ring 54 coupled to a coupling section 68 of each membrane 46. For example, the coupling section 68 can be coupled to the mounting ring 54 via a piston 48 and an optional insert 70. The mounting ring 54 may be oriented to form a mounting angle $\theta_M$ relative to the body axis. For example, a set mounting angle $\theta_M$ can be defined to provide a particular stroke length S. The mounting ring 54 can be positioned so that the mounting angle $\theta_M$ originates from a particular location, i.e., a first mounting origin, along the body axis. As shown in FIGS. 3 and 4, the first mounting origin can be aligned along the body axis with the outer edge of each membrane, i.e., the neutral position N of the membrane 46.

Figure 7:
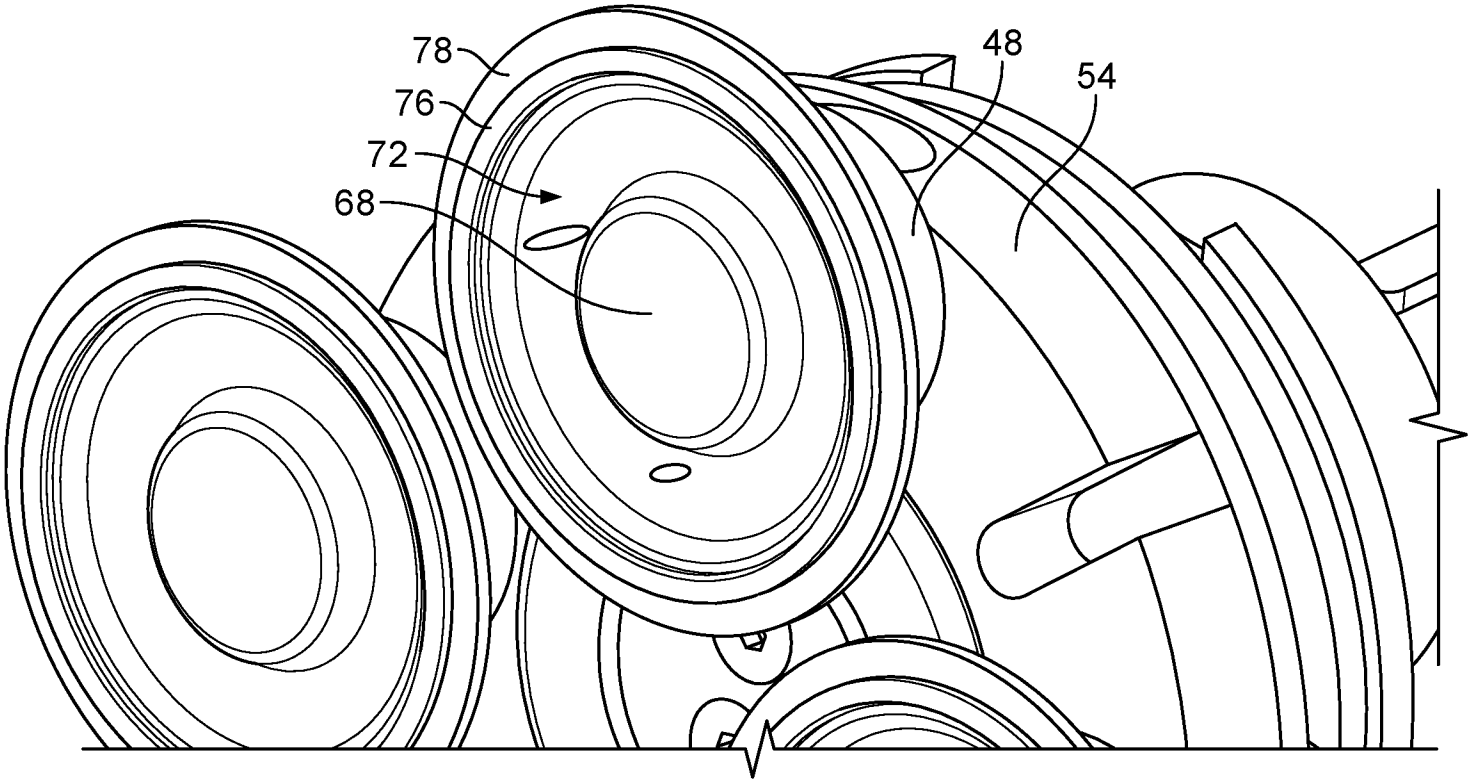
FIG. 7 depicts a 3D CAD model of a membrane.

The method can include simulating the deflection of at least one membrane 46 relative to the body axis. FIG. 7 shows an example 3D CAD model that can be used to simulate the deflection of the at least one membrane 46. For example, the 3D CAD model can be used to simulate the motion path of several points along the surface of the membrane 46. At least one of the points coincides with the coupling section 68, while the other points may be located along the deflection section 72. For example, the simulation points may coincide with an apex 80 of the deflection section 72 (FIG. 6A), at which larger movements can be observed than at other parts of the membrane 46. In other embodiments, the simulation points may be located elsewhere along the deflection section 72, e.g., where the deflection section 72 and the sealing flange 61 meet.

After simulating the deflection of the membrane 46 for the first mounting origin, the method can further include translating the mounting ring 54 along the body axis while maintaining the same mounting angle $\theta_M$, such that the mounting angle $\theta_M$ originates from a second mounting origin along the body axis that is different from the first mounting origin. For example, translating the mounting ring 54 can include increasing a thickness of the carrier plate 50 along the body axis or increasing a length of the pistons 48.

The method can include simulating the deflection of at least one membrane relative to the body axis for the second mounting origin and selecting the first mounting origin or the second mounting origin based on the simulated deflection of the at least one membrane relative to the body axis. For example, the selection can be based on the mounting origin that results in less transverse movement of the deflection section 72. In FIG. 7, movement of points on the membrane will show as elliptical when there is some amount of transverse movement, whereas movement only along the diaphragm axis is indicated by a line.

While a number of examples have been described for illustration purposes, the foregoing description is not intended to limit the scope of the invention, which is defined by the scope of the appended claims. There are and will be other examples and modifications within the scope of the following claims.

What is claimed is:

1. A method of designing a diaphragm pump, the method comprising:

designing a body defining a plurality of diaphragm chambers spaced apart about a body axis, wherein each diaphragm chamber defines a membrane opening, an inlet chamber in fluid communication with each diaphragm chamber, and an outlet chamber in fluid communication with each diaphragm chamber;

designing a plurality of flexible membranes that each comprise an outer edge, wherein the body is configured to clamp the outer edge of each membrane along a corresponding membrane opening to seal a corresponding one of the diaphragm chambers, and wherein the membranes are configured to deflect substantially in parallel to the body axis to suction fluid into each diaphragm chamber from the inlet chamber and discharge fluid from each diaphragm chamber into the outlet chamber;

designing a mounting ring coupled to a coupling section of each membrane;

orienting the mounting ring to form a mounting angle relative to the body axis, the mounting angle originating from a first mounting origin along the body axis;

simulating deflection of at least one membrane relative to the body axis;

translating the mounting ring along the body axis, such that the mounting angle originates from a second mounting origin along the body axis that is different from the first mounting origin;

simulating deflection of at least one membrane relative to the body axis; and selecting the first mounting origin or the second mounting origin based on the simulated deflection of the at least one membrane relative to the body axis; and providing the diaphragm pump comprising the mounting ring mounted using the elected one of the first mounting origin or the second mounting origin, and wherein the mounting ring is positioned such that the origin of the mounting angle along the body axis of the diaphragm pump aligns with a neutral position of the membranes that corresponds with an outer edge of the membranes to, thereby, restrict movement of the coupling section radial to and about the body axis and suppress movement of a deflection section of the membranes radial to and about the body axis.

2. The method of claim 1, wherein simulating the deflection of at least one membrane relative to the body axis is based on a 3D CAD simulation.

3. The method of claim 1, wherein translating the mounting ring along the body axis includes modifying a thickness of the body between the flexible membranes and the mounting ring.

4. The method of claim 1, wherein designing the mounting ring comprises coupling the coupling section of each membrane to the mounting ring via a piston.

5. The method of claim 4, wherein translating the mounting ring along the body axis includes modifying a length of the pistons.

6. The method of claim 1, wherein translating the mounting ring along the body axis, such that the mounting angle originates from a second mounting origin along the body axis that is different from the first mounting origin comprises holding mounting angle relative to the body axis constant while translating the mounting ring along the body axis.

7. A method of assembling a diaphragm pump, comprising:

providing a body defining a plurality of diaphragm chambers spaced apart about a body axis, wherein each diaphragm chamber defines a membrane opening and is in communication with both an inlet chamber and an outlet chamber;

providing a plurality of flexible membranes that each comprise an outer edge wherein each membrane comprises:

a coupling section configured to be coupled to a mounting ring of a pump drive, and a deflection section arranged radially outwardly from the coupling section and configured to deflect in response to movement of the pump drive;

clamping the outer edge of each membrane to the body along a corresponding membrane opening to seal a corresponding one of the diaphragm chambers; and coupling the coupling section of each of the flexible membranes to the mounting ring, wherein the mounting ring defines a mounting ring axis that forms a mounting angle with the body axis, and wherein the mounting ring is positioned such that an origin of the mounting angle along the body axis aligns with a neutral position of the membranes that corresponds with an outer edge of the membranes to, thereby, restrict movement of the coupling section radial to and about the body axis and suppress movement of the deflection section radial to and about the body axis.

8. The method of claim 7, further comprising:

providing the mounting ring configured to wobble about the body axis in response to movement of the pump drive;

coupling the coupling section of each membrane to the mounting ring; and mounting the mounting ring to the pump drive at the mounting angle.

9. The method of claim 7, further comprising supporting the coupling section of each membrane with a rigid piston that suppresses deflection of the coupling section.

10. The method of claim 7, wherein movement of the coupling section along a diaphragm axis defines a stroke length, and wherein the method further comprises providing the deflection section with an arcuate length greater than the stroke length in cross-section.

11. The method of claim 7, further comprising forming the outer edge of each membrane with a sealing bead having a substantially circular or semi-circular cross-section.

12. The method of claim 11, further comprising forming the outer edge of the membrane with a sealing lip arranged radially outward from the sealing bead, wherein the sealing lip has a smaller thickness than the sealing bead.

13. The method of claim 7, wherein the body is formed of stainless steel.

14. The method of claim 7, wherein the body is formed of plastic.

* * * * *